US008665114B2

(12) United States Patent
Cozens

(10) Patent No.: US 8,665,114 B2
(45) Date of Patent: Mar. 4, 2014

(54) DISPLAY

(76) Inventor: Derek Cozens, Hertfordshire (GB)

( * ) Notice: Subject to any disclaimer, the term of this patent is extended or adjusted under 35 U.S.C. 154(b) by 388 days.

(21) Appl. No.: 13/071,649

(22) Filed: Mar. 25, 2011

(65) Prior Publication Data

US 2011/0169662 A1 Jul. 14, 2011

Related U.S. Application Data

(63) Continuation of application No. PCT/GB2009/051116, filed on Sep. 3, 2009.

(30) Foreign Application Priority Data

Oct. 1, 2008 (GB) ..... 0817867

(51) Int. Cl.
*G08G 1/095* (2006.01)

(52) U.S. Cl.
USPC ..... 340/907; 340/931; 340/953; 340/642; 340/908; 340/916; 315/130

(58) Field of Classification Search
USPC ..... 340/931, 953, 642, 908, 916; 315/130
See application file for complete search history.

(56) References Cited

U.S. PATENT DOCUMENTS

| | | | | |
|---|---|---|---|---|
| 5,387,909 | A * | 2/1995 | Neel et al. | 340/931 |
| 6,827,522 | B2 | 12/2004 | Kodama et al. | |
| 2002/0005790 | A1 * | 1/2002 | Georgalis | 340/929 |
| 2002/0067290 | A1 * | 6/2002 | Peet et al. | 340/907 |
| 2005/0057941 | A1 * | 3/2005 | Pederson et al. | 362/542 |
| 2007/0176791 | A1 * | 8/2007 | Bolotin et al. | 340/929 |
| 2008/0198038 | A1 * | 8/2008 | Yingst et al. | 340/908 |
| 2008/0315776 | A1 * | 12/2008 | Openiano | 315/185 R |

FOREIGN PATENT DOCUMENTS

| | | | |
|---|---|---|---|
| AU | 2004100135 | A4 | 7/2004 |
| DE | 2716514 | A1 | 11/1978 |
| EP | 1045360 | A1 | 4/1999 |

OTHER PUBLICATIONS

Search Report of GB0817867.5; Jan. 23, 2009; 4 pgs.

* cited by examiner

*Primary Examiner* — Daryl Pope

(74) *Attorney, Agent, or Firm* — Gardner Groff Greenwald & Villanueva, PC

(57) ABSTRACT

The present invention provides a display for traffic control within a region of traffic flow, comprising an array of lights arranged for illumination to indicate to traffic seeking to negotiate the region in accordance with a first path of travel the likely movement of traffic seeking to negotiate the region in accordance with a second path of travel different from the first, and thus whether said traffic seeking to negotiate the region in accordance with said second path of travel has a right of way over traffic seeking to negotiate the region in accordance with said first path of travel.

23 Claims, 8 Drawing Sheets

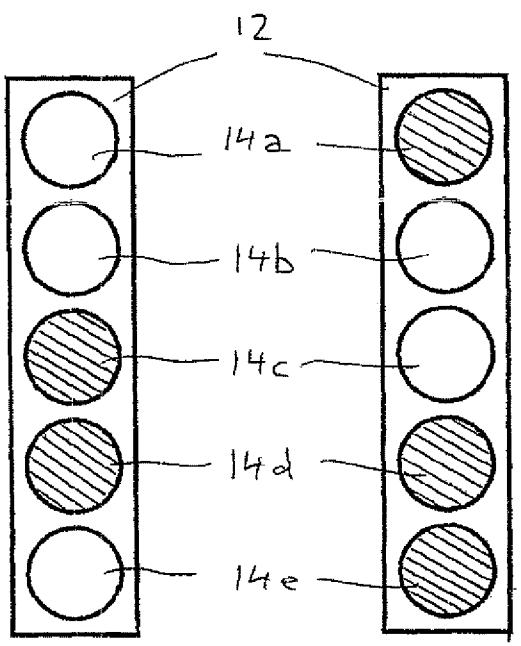
Fig. 2d
Fig. 2c
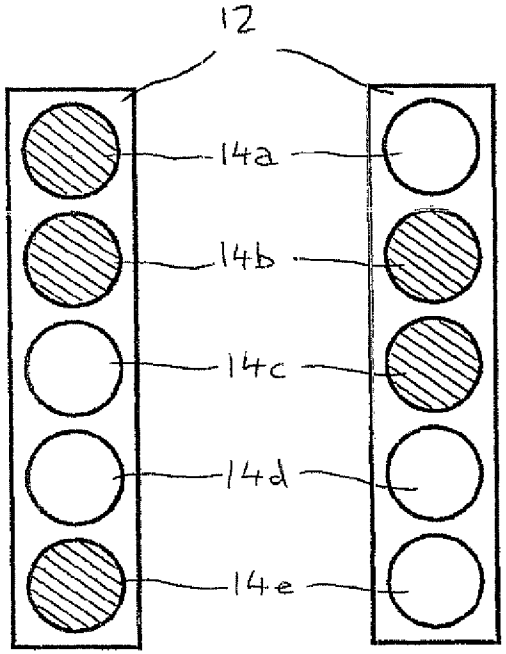
Fig. 2b
Fig. 2a

DISPLAY

CROSS-REFERENCE TO RELATED APPLICATIONS

This application is a continuation of International PCT Patent Application No. PCT/GB2009/051116 filed Sep. 3, 2009, which claims the benefit of United Kingdom Application GB 0817867.5 filed on Oct. 1, 2008, which are incorporated herein by reference in their entireties for all purposes.

BACKGROUND

The present invention relates to a display and, particularly, to a display for traffic control applications.

Traffic control systems incorporating displays for controlling flow of vehicular and pedestrian traffic at intersections are well known. Such conventional systems comprise a network of displays, with each display comprising red, amber and green lights. Each display operates in a predetermined sequence in order to control traffic flow in a particular direction. The displays within the network are linked to a central control processor which is operable to control the network of displays so that traffic converging on a junction from different directions is able to negotiate the junction in an ordered manner.

These conventional traffic control systems can suffer problems, however, particularly when controlled traffic flows are bi-directional, and accidents can occur because the displays do not convey adequately the status of the opposing traffic flows.

The present invention seeks to provide for a display having advantages over known such displays.

SUMMARY

According to an aspect of the present invention, there is provided a display for traffic control within a region of traffic flow, comprising an array of lights arranged for illumination to indicate to traffic seeking to negotiate the region in accordance with a first path of travel the likely movement of traffic seeking to negotiate the region in accordance with a second path of travel different from the first, and thus whether said traffic seeking to negotiate the region in accordance with said second path of travel has a right of way over traffic seeking to negotiate the region in accordance with said first path of travel.

An advantage of the present invention is that a driver in a vehicle approaching an intersection having a traffic control system incorporating displays according to the invention is provided with visual information by way of the display regarding the status of other traffic flows at and/or entering the intersection.

Further, it can assist drivers in making an informed decision on making a turn, for example, a right turn which will result in a vehicle crossing the path of travel of vehicles which may be free to flow in the opposite direction (as in the United Kingdom).

Preferably, said lights of said array are arranged for illumination sequentially.

Conveniently, said lights of said array are arranged for illumination in a predetermined sequence to indicate a likely movement of traffic seeking to negotiate the region in accordance with a second path of travel different from the first.

Further, the lights may be illuminated in a manner that indicates movement of particular traffic flows, for example, from top to bottom in the array, left to right in the array, etc., to give information on the other traffic flows within the region or to assist in informing drivers when they are safe to continue and/or carry out a manoeuvre in the region.

Also, said display may be arranged for control by processing means.

If required, the display may further comprise a user interface coupled to said processing means, and for enabling an operator to input timing, light colour and illumination sequences for the display to said processing means.

In particular, the display may be arranged for retrofitting at any road junction and configured to operate in conjunction with the existing control systems.

Also, the system may be configured for mounting on existing traffic light support systems such that it can utilise the voltage supplies available to the existing traffic lights, thereby requiring no additional output connections from the traffic light control systems.

In particular, said display may be arranged to receive power by way of an existing traffic light power supply.

Further, said display may be arranged for mounting on an existing traffic light installation.

Preferably, said display is operable to initiate pre-programmed illumination sequences of lights in said array of lights based upon a change of state of an existing traffic light system to which it is coupled. The timing, speed and colour of the light sequence may programmable within the unit and, conveniently, the change of state of the existing light system may trigger the illumination sequence.

This display can preferably be mounted so as to be easily visible to traffic entering and/or within a traffic light controlled junction.

Conveniently, the lights of said array are of the same colour.

Alternatively, the lights of the display may be of different colours, including red, amber, green, in order to suit different traffic control applications.

Alternatively, the display of the present invention may be used as the main component of a traffic control system, thereby replacing conventional three light displays.

In a further alternative, a computer controlled full colour matrix display can be used in place of the array of lights in the display described above. Overall, this will provide a similar sequential display, but with the additional benefit of being able to display more detailed graphics or alphanumeric characters.

According to another aspect of the present invention, there is provided a method of controlling traffic within a region of traffic flow including the step of illuminating an array of lights so as to indicate to traffic seeking to negotiate the region in accordance with a first path of travel the likely movement of traffic seeking to negotiate the region in accordance with a second path of travel different from the first, and thus whether said traffic seeking to negotiate the region in accordance with said second path of travel has a right of way over traffic seeking to negotiate the region in accordance with said first path of travel.

Preferably, the method includes illuminating lights of said array of lights sequentially.

Conveniently, said illumination step comprises a predetermined sequence to indicate a likely movement of traffic seeking to negotiate the region in accordance with a second path of travel different from the first.

According to a further aspect of the present invention, there is provided a computer program product comprising processor implementable instructions for controlling a processor to implement the method described above.

According to another aspect of the present invention, there is provided a storage medium storing a computer program product as described above.

According to another aspect of the present invention, there is provided processor implementable instructions for controlling a processor to implement the method as described above.

According to yet another aspect of the present invention, there is provided a traffic junction comprising at least one display as described above.

According to another aspect of the present invention, there is provided a display arrangement for traffic control within a region of traffic flow, comprising a first array of lights arranged for illumination in a scrolling sequence to indicate to traffic seeking to negotiate the region via a first path of travel a direction of onward traffic flow.

The display arrangement may further comprise a second array of lights arranged for illumination in a scrolling sequence to indicate to traffic approaching the region via a second path of travel a direction of oncoming traffic flow in the region to prevent flow via said second path of travel in said region.

According to a further aspect of the present invention, there is provided a method of controlling traffic within a region of traffic flow including the step of illuminating a first array of lights in a scrolling sequence to indicate to traffic seeking to negotiate the region via a first path of travel a direction of onward traffic flow.

The method may further comprise the step of illuminating a second array of lights in a scrolling sequence to indicate to traffic approaching the region via a second path of travel a direction of oncoming traffic flow in the region to prevent flow via said second path of travel in said region.

DESCRIPTION OF THE DRAWINGS

The present invention is described further hereinafter, by way of example only, with reference to the accompanying drawings in which:

FIGS. 2*a* to 2*d* illustrate an illumination sequence of the display of FIG. 1 for traffic flow control;

DETAILED DESCRIPTION

Figure 1:
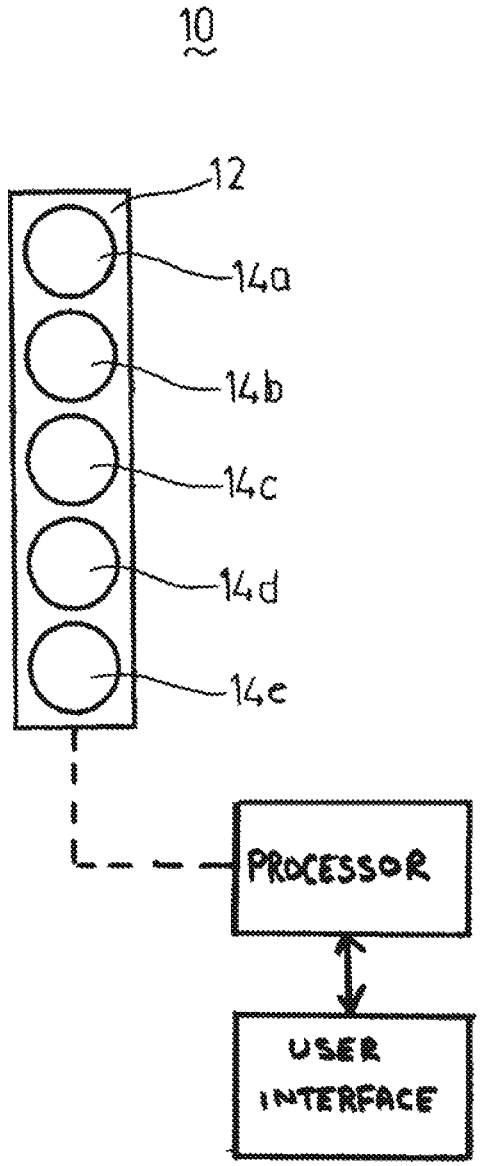
FIG. 1 illustrates a display according to a first embodiment of the present invention.

In FIG. 1, there is illustrated a display 10 for a traffic control application at an intersection such as a cross-roads, T-junction, etc. The display 10 comprises a light array 12 having a plurality of lights. The illustrated display 10 comprises five lights 14*a* to 14*e* in the light array 12.

Preferably, and as illustrated, all five lights 14*a* to 14*e* are identical and are equally spaced in the light array 12. The lights may be of any colour, including red, amber and green but, in a preferable arrangement are of the same colour.

The five lights 14*a* to 14*e* are operable to illuminate in a predetermined sequence to indicate a direction of traffic flow entering an intersection at which the display 10 is located. For example, to indicate traffic flow approaching an observer, the sequence of illumination of the five lights 14*a* to 14*e* will be from the top of the display 10 as illustrated, to the bottom.

FIGS. 2*a* to 2*d* illustrate such an illumination sequence, with illuminated lights being denoted by way of hatched lines. The order of the illumination sequence is described in the following Table 1.

TABLE 1

| ILLUMINATION STEP | ILLUMINATED LIGHTS | ILLUSTRATED IN: |
|---|---|---|
| 1 | 14a, 14b, 14e | FIG. 2a |
| 2 | 14b, 14c | FIG. 2b |
| 3 | 14c, 14d | FIG. 2c |
| 4 | 14a, 14d, 14e | FIG. 2d |

When the fourth illumination step has been reached, the illumination sequence returns to the first illumination step and the sequence is repeated.

To aid clarity in the above described FIGS. 1 and 2*a* to 2*d*, the power and connection terminals for the display 10 are not illustrated. However, it should be appreciated that the display 10 may be powered by way of any suitable power source. Additionally, the display 10 may be controlled by way of any suitable processing means.

In another arrangement, such a display 10 can also be incorporated into traffic control applications where a flow of traffic is unidirectional, e.g. as in a one-way street or an exit lane of a motorway (freeway).

When located on an exit lane of a motorway, such a display 10 would be positioned so as to be visible by traffic travelling in the wrong direction with respect to the correct direction for the exit lane, i.e. in the opposite direction to traffic travelling in the correct direction along the exit lane.

In such an arrangement, the sequence of illumination is preferably the same as that illustrated in FIGS. 2*a* to 2*d* and as described in Table 1, i.e. the sequence of illumination of the five lights 14*a* to 14*e* will be from the top of the display 10 as illustrated, to the bottom. Preferably, the lights 14*a* to 14*e* are red in colour.

In a further adaptation of this arrangement suitable for installation on a one-way street, a first display would again be positioned so as to face traffic approaching the first display in the wrong direction i.e. in the opposite direction to traffic travelling in the correct direction along the one-way street.

However, in this arrangement, a second display is preferably mounted back-to-back with the first display. As will be appreciated, this second display will face traffic travelling in the correct direction along the one-way street. In such an arrangement, the sequence of illumination of the first display is preferably the same as that illustrated in FIGS. 2*a* to 2*d* and as described in Table 1, i.e. the sequence of illumination of the five lights 14*a* to 14*e* will be from the top of the display 10 as illustrated, to the bottom.

Preferably, the lights of the first display are red in colour. The sequence of illumination of the second display is preferably the opposite to that of the first display, i.e. the sequence of illumination of the five lights will be from the bottom of the display to the top. Preferably, the lights of the second display are green in colour.

Figure 3:
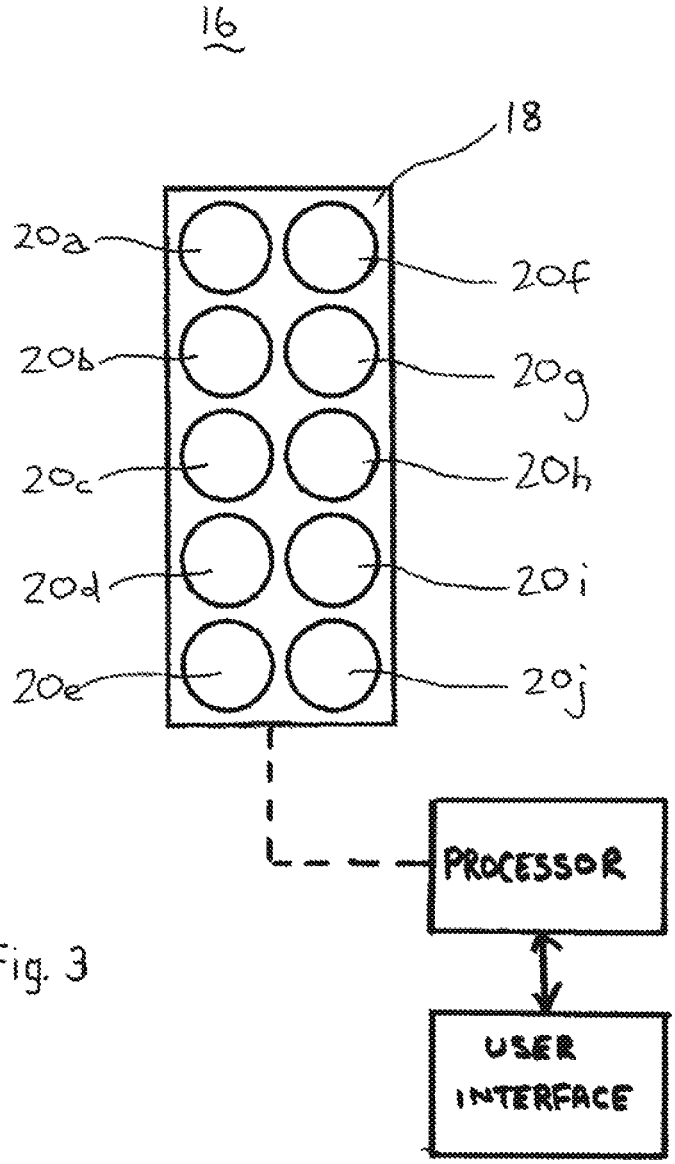
FIG. 3 illustrates a display according to a second embodiment of the present invention.

In FIG. 3, there is illustrated a display 16 for a traffic control application at an intersection such as a cross-roads, T-junction, etc. in another embodiment. The display 16 comprises a light array 18 having a plurality of lights.

The illustrated display 16 comprises ten lights 20*a* to 20*j* in the light array 18. As can be seen, the ten lights 20*a* to 20*j* are arranged in two parallel vertical banks, with a first bank containing five lights 20*a* to 20*e*, and a second bank containing five lights 20*f* to 20*j*.

Preferably, and as illustrated, all ten lights 20*a* to 20*j* are identical and are equally spaced in the light array 18. The lights may be of any colour, including red, amber and green but, in a preferable arrangement are of the same colour.

The ten lights 20*a* to 20*j* are operable to illuminate in a predetermined sequence. In one possible arrangement, the predetermined sequence is suitable for indicating, to an observer, when it is clear to turn their vehicle to the right, perhaps across traffic flowing in an opposite direction. Additionally, or alternatively, the same predetermined sequence is suitable for indicating, to an observer, when it is safe to proceed forwards.

In the above described arrangements, the sequence of illumination of the ten lights 20*a* to 20*j* will be from the bottom of the display 16 as illustrated, to the top, with the colour of the lights, preferably, being green.

FIGS. 4*a* to 4*d* illustrate such an illumination sequence, with illuminated lights being denoted by way of hatched lines. The order of the illumination sequence is described in the following Table 2.

TABLE 2

Figures 4A, 4B, 4C, 4D:
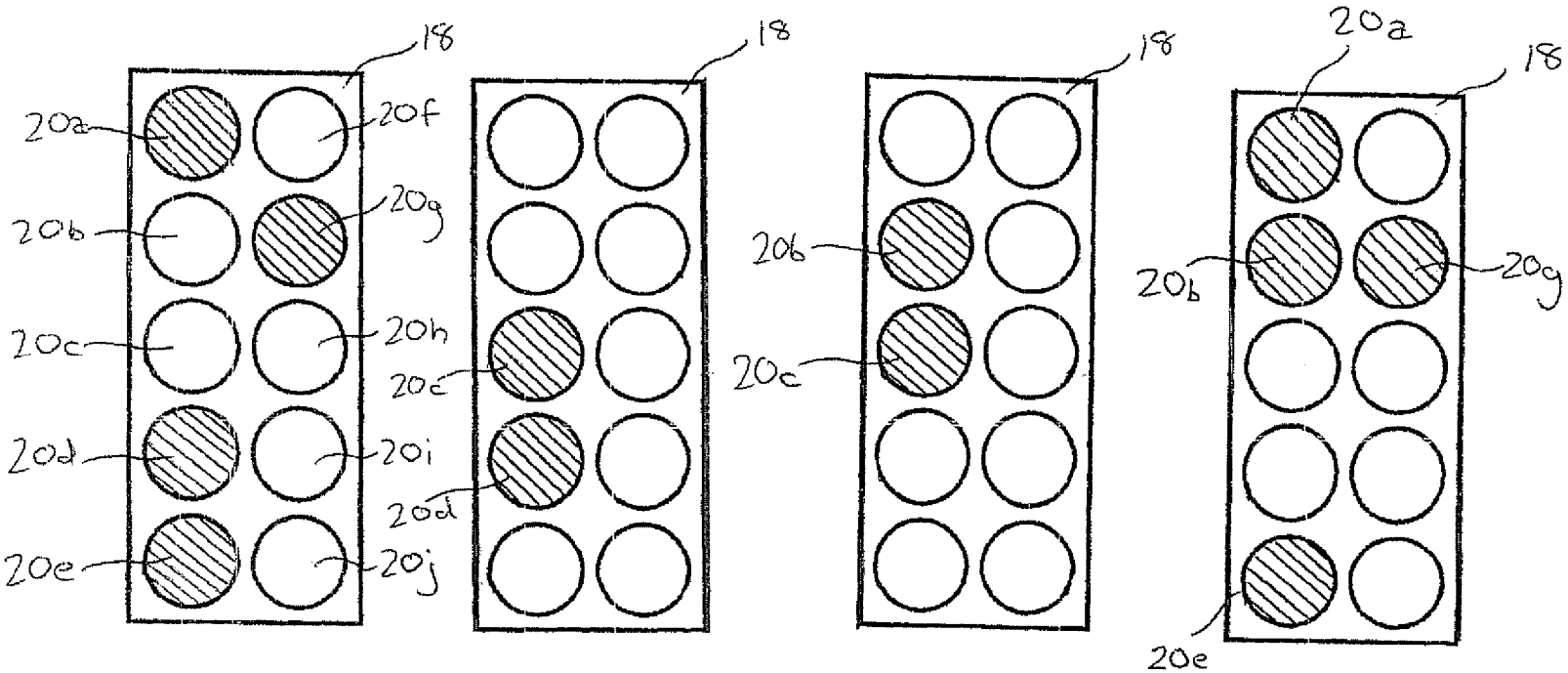
FIGS. 4*a* to 4*d* illustrate an illumination sequence of the display of FIG. 3 for traffic flow control.

| ILLUMINATION STEP | ILLUMINATED LIGHTS | ILLUSTRATED IN: |
|---|---|---|
| 1 | 20a, 20d, 20e, 20g | FIG. 4a |
| 2 | 20c, 20d | FIG. 4b |
| 3 | 20b, 20c | FIG. 4c |
| 4 | 20a, 20b, 20e, 20g | FIG. 4d |

When the fourth illumination step has been reached, the illumination sequence returns to the first illumination step and the sequence is repeated.

Figure 5A:
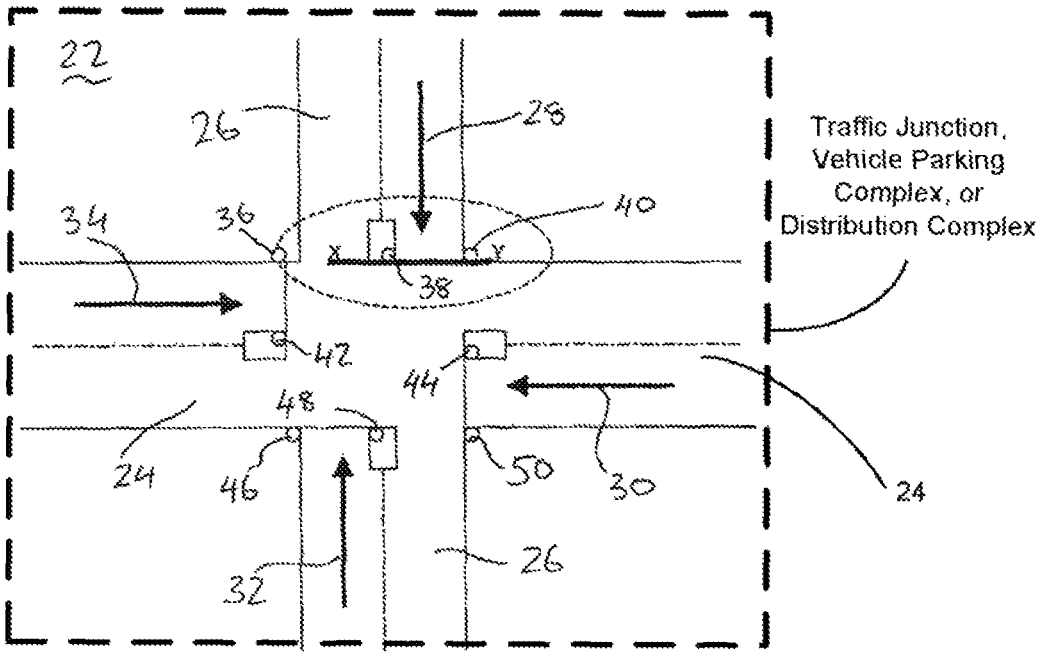
FIG. 5*a* illustrates a schematic plan view of a crossroad junction in which the traffic control system incorporates the display of FIG. 1.

FIG. 5*a* illustrates a plan view of a road junction 22 in which two roads 24, 26 intersect to form a cross-road type junction. The directions of traffic approaching the junction 22 from the roads 24, 26 are indicated by way of arrows 28, 30, 32 and 34.

The junction 22 further comprises conventional traffic control displays 36 to 50, at least one of which, and preferably all of which, include(s) the display of FIG. 1.

Figure 5B:
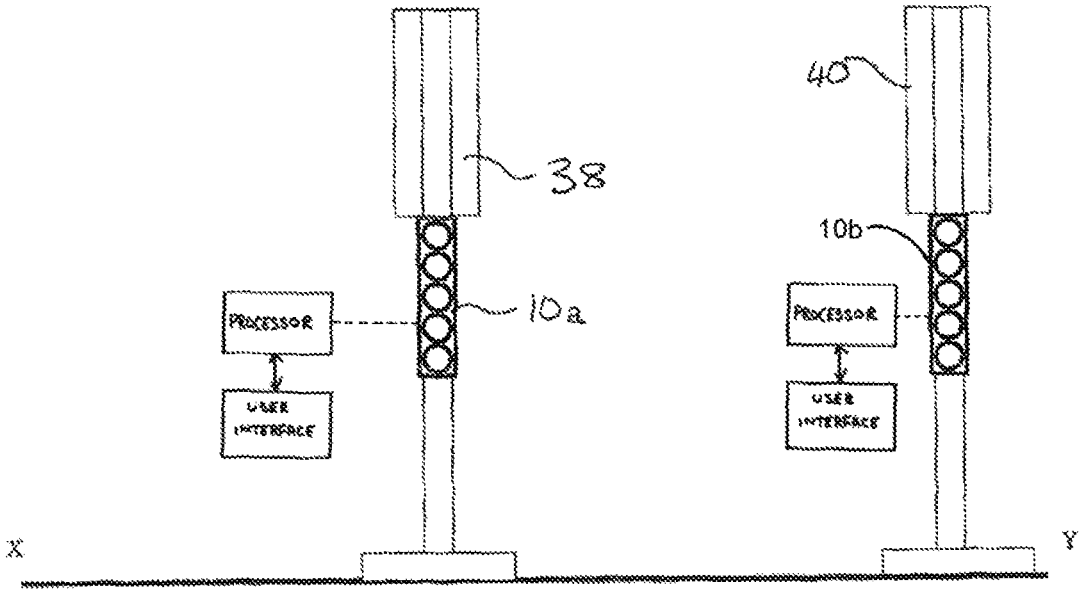
FIG. 5*b* illustrates a cross-section through the line X-Y of FIG. 5*a;*

FIG. 5*b* illustrates a cross-sectional view of the junction 22 taken along line X-Y of FIG. 5*a*.

This figure illustrates an arrangement where the displays are located on the rear of conventional three-light displays to be viewed by traffic approaching from the opposite direction. Thus, as illustrated in FIG. 5*b*, conventional three-light displays 38, 40, have mounted thereon displays 10*a*, 10*b* according to the present invention.

Figure 6:
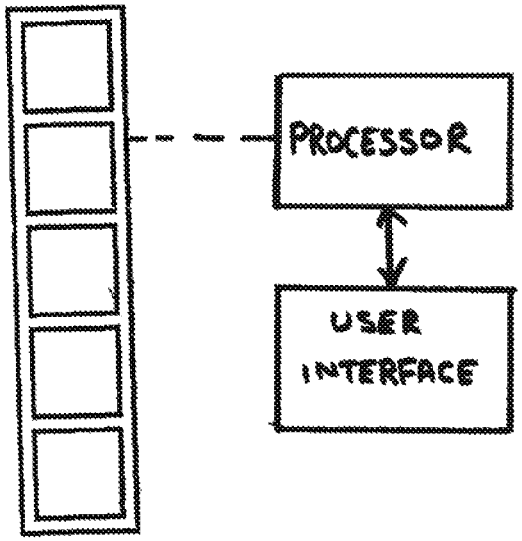
FIG. 6 illustrates an alternative arrangement of the display of FIG. 1.
Figure 7:
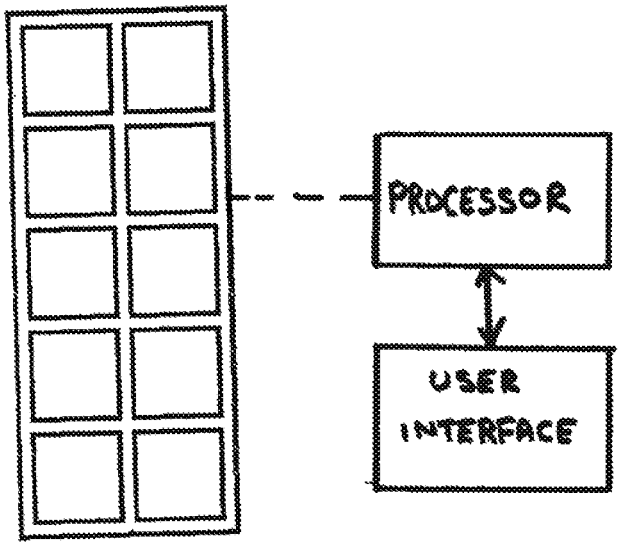
FIG. 7 illustrates an alternative arrangement of the display of FIG. 3.

FIGS. 6 and 7 illustrate alternative arrangements for the displays 10, 16 of FIGS. 1 and 3 respectively.

As illustrated in FIGS. 6 and 7, square lights replace the circular lights of the arrangements of FIGS. 1 and 3.

In the above description, the term light/lights can include light emitting diodes, incandescent lamps, or any other suitable light emitting means.

Figure 8A:
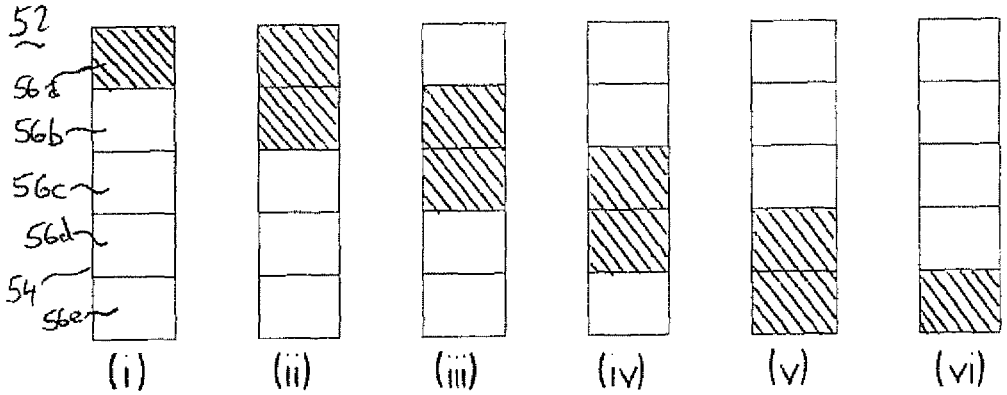
FIGS. 8*a* to 8*c* illustrate an illumination sequence in another arrangement.
Figure 8B:
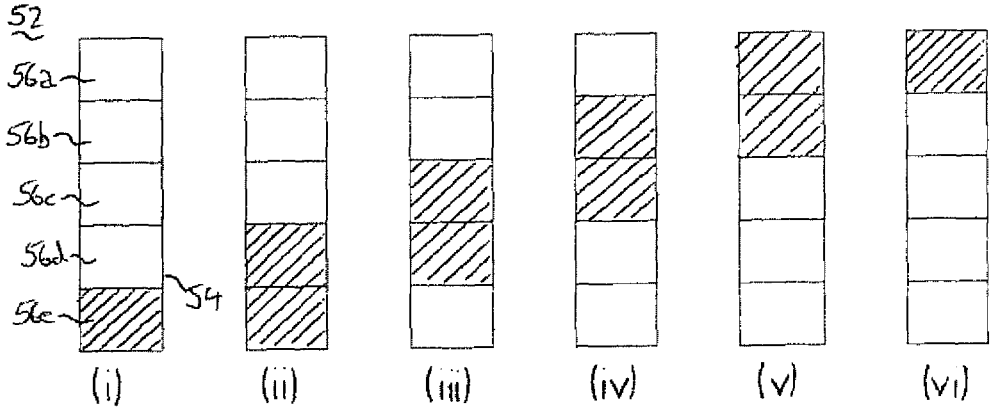
Figure 8C:
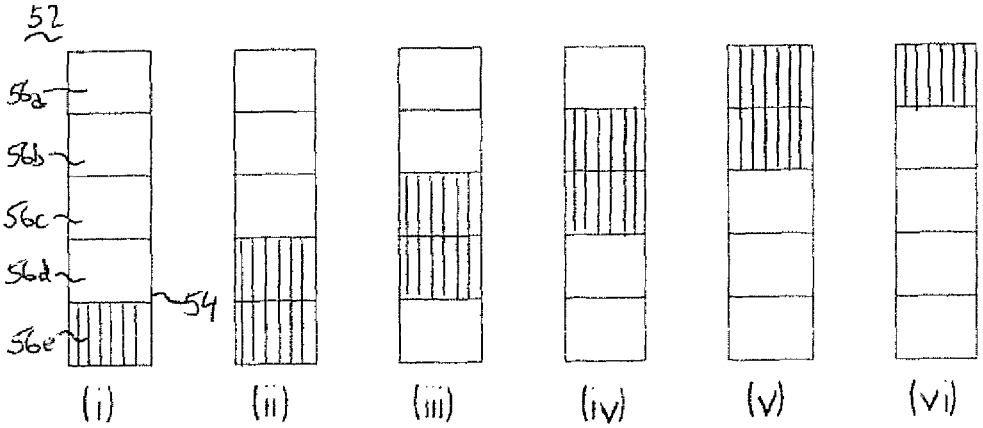

FIGS. 8*a* to 8*c* illustrate another arrangement of the present invention. Such an arrangement may be suitable for use in off-road areas such as, for example, car parks, or for control of vehicles in a distribution complex.

In this arrangement, a display 52 comprises a light array 54 having a plurality of lights. The illustrated display 52 comprises five lights 56*a* to 56*e* in the light array 54.

The five lights 56*a* to 56*e* are operable for illumination in a predetermined sequence to provide information to drivers of vehicles approaching the display 52. This information may comprise, for example, a warning of a wrong direction of travel, directions to an exit, or directions to a parking area.

FIGS. 8*a* to 8*c* illustrate such an illumination sequence, with illuminated lights being denoted by way of hatched lines. In FIG. 8*a*, the lights are the colour red, in FIG. 8*b*, the lights are the colour green and, in FIG. 8*c*, the lights have the colour blue. The order of the illumination sequence illustrated in FIG. 8*a* is described in the following Table 3.

TABLE 3

| ILLUMINATION STEP | ILLUMINATED LIGHTS | ILLUSTRATED IN: |
|---|---|---|
| 1 | 56a | FIG. 8a(i) |
| 2 | 56a, 56b | FIG. 8a(ii) |
| 3 | 56b, 56c | FIG. 8a(iii) |
| 4 | 56c, 56d | FIG. 8a(iv) |
| 5 | 56d, 56e | FIG. 8a(v) |
| 6 | 56e | FIG. 8a(vi) |

The order of the illumination sequences illustrated in FIGS. 8*b* and 8*c* are described in the following Table 4.

TABLE 4

| ILLUMINATION STEP | ILLUMINATED LIGHTS | ILLUSTRATED IN: |
|---|---|---|
| 1 | 56e | FIGS. 8b(i) & 8c(i) |
| 2 | 56e, 56d | FIGS. 8b(ii) & 8c(ii) |
| 3 | 56d, 56c | FIGS. 8b(iii) & 8c(iii) |
| 4 | 56c, 56b | FIGS. 8b(iv) & 8c(iv) |
| 5 | 56b, 56a | FIGS. 8b(v) & 8c(v) |
| 6 | 56a | FIGS. 8b(vi) & 8c(vi) |

When the sixth illumination step has been reached the illumination sequence returns to the first illumination step and the sequence is repeated.

Thus, the display of FIG. 8*a* displays a downward sequence of red lights which are arranged to warn of travel in an incorrect direction, e.g. for unidirectional traffic flows to indicate to traffic travelling against the flow that it is travelling in the wrong direction.

The upwards sequence of green lights in FIG. 8*b* could be employed to indicate a direction that a vehicle should follow to reach, for example, an exit, and the upwards sequence of blue lights in FIG. 8*c* could be employed to indicate a direction that a vehicle should follow to reach, for example, a parking area.

Figure 9:
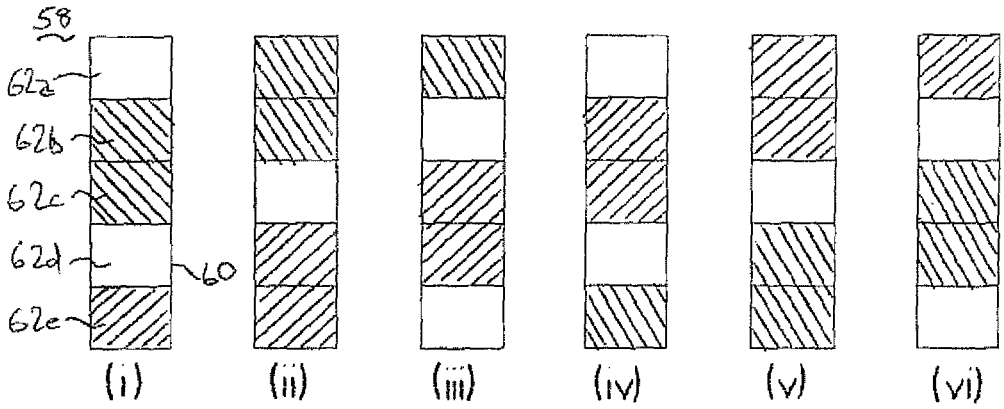
FIG. 9 illustrates an illumination sequence in a further arrangement.

FIG. 9 illustrates a further arrangement of the present invention. Again, such an arrangement may be suitable for use in off-road areas such as, for example, car parks, or in a distribution complex.

In this arrangement, a display 58 comprises a light array 60 having a plurality of lights. The illustrated display 58 comprises five lights 62*a* to 62*e* in the light array 60.

The five lights 62*a* to 62*e* are operable for illumination in a predetermined sequence to provide information to drivers of vehicles approaching the display 58. This information may comprise a combination of directional information to, for example, an exit and to a parking area.

FIG. 9 illustrates such an illumination sequence, with illuminated lights being denoted by way of hatched lines and with differing colours being indicated by different direction hatched lines. The display of FIG. 9 employs a combination of first and second colour lights (preferably green and blue). The order of the illumination sequence illustrated in FIG. 9 is described in the following Table 5.

TABLE 5

| ILLUMINATION STEP | ILLUMINATED LIGHTS | ILLUSTRATED IN: |
|---|---|---|
| 1 | 62e (first colour)<br>62c, 62b (second colour) | FIG. 9(i) |
| 2 | 62e, 62d (first colour)<br>62b, 62a (second colour) | FIG. 9(ii) |
| 3 | 62d, 62c (first colour)<br>62a (second colour) | FIG. 9(iii) |
| 4 | 62c, 62b (first colour)<br>62e (second colour) | FIG. 9(iv) |
| 5 | 62b, 62a (first colour)<br>62e, 62d (second colour) | FIGS. 9(v) |
| 6 | 62a (first colour)<br>62d, 62c (second colour) | FIGS. 9(vi) |

The upwards combined sequence of lights of first and second colours in FIG. 9 could be employed to indicate a direction that a vehicle should follow to reach, for example, both an exit and a parking area.

In another arrangement, a processor for controlling the displays is connected to a remote switching apparatus. Individual displays could be switched on and off, and/or between any of the modes of operation described above. Such a remote switching apparatus may comprise, for example, electrical switches or a central control system, and the connection could be via a network, serial data or DC switching.

An example of an application which makes use of a remote switching apparatus would be in the management of vehicle movements in a complex, for example, to allow the control of vehicles to sequentially fill vacant parking areas.

The invention claimed is:

1. A display for traffic control within a region of traffic flow, characterized by: a first array of lights arranged for illumination in two scrolling sequences, wherein in a first scrolling sequence lights of said first array are illuminated in sequence from top to bottom of said first array, the first scrolling sequence indicative to an observer viewing said first array of the display a direction of oncoming traffic flow, and wherein in a second scrolling sequence, lights of said first array are illuminated in sequence from bottom to top of said first array, the second scrolling sequence indicative to an observer viewing said first array of the display a direction of onward traffic flow toward said display.

2. A display according to claim 1, further comprising a second array of lights operative in conjunction with said first array of lights when said first array is illuminating lights according to said first scrolling sequence, said second array arranged for illumination in a second array scrolling sequence in which lights of said second array are illuminated in sequence from bottom to top of said second array, the second array scrolling sequence indicative to an observer viewing said second array of the display a direction of onward traffic flow toward said display.

3. A display according to claim 1, wherein said first array comprises five lights and said first scrolling sequence comprises illumination of said five lights in the following sequence:

(i) first, second and fifth lights illuminated;
(ii) second and third lights illuminated;
(iii) third and fourth lights illuminated;
(iv) first, fourth and fifth lights illuminated; and
(v) repeat steps (i) to (iv).

4. A display according to claim 2, wherein said second array comprises five lights and said second array scrolling sequence comprises illumination of said five lights in the following sequence:

(i) first, fourth and fifth lights illuminated
(ii) third and fourth lights illuminated;
(iii) second and third lights illuminated;
(iv) first, second and fifth lights illuminated; and
(v) repeat steps (i) to (iv).

5. A display according to claim 1, wherein said first array comprises five lights and said first scrolling sequence comprises illumination of said five lights in the following sequence:

(i) first light illuminated;
(ii) first and second lights illuminated;
(iii) second and third lights illuminated;
(iv) third and fourth lights illuminated;
(v) fourth and fifth lights illuminated;
(vi) fifth light illuminated; and
(vii) repeat steps (i) to (vi).

6. A display according to claim 1, wherein said display is arranged for control by processing means.

7. A display according to claim 6, further comprising a user interface coupled to said processing means, and for enabling an operator to input timing, light colour and illumination sequences for the display to said processing means.

8. A display according to claim 1, wherein said display is arranged to receive power by way of an existing traffic light power supply.

9. A display according to claim 1, wherein said display is arranged for mounting on an existing traffic light installation.

10. A display according to claim 1, wherein said display is operable to initiate pre-programmed illumination sequences of lights in said array of lights based upon a change of state of an existing traffic light system to which it is coupled.

11. A display according to claim 1, wherein said display is operable to control traffic at a traffic junction.

12. A display claim 1, wherein said display is operable to control traffic in a vehicle parking complex.

13. A display according to claim 1, wherein said display is operable to control traffic in a distribution complex.

14. A method of controlling traffic within a region of traffic flow including the steps of: illuminating a first array of lights in two scrolling sequences, a first scrolling sequence comprising illuminating lights of said first array in sequence from top to bottom of said first array, the first scrolling sequence indicative to an observer viewing said first array of the display a direction of oncoming traffic flow, and a second scrolling sequence comprising illuminating lights of said first array in sequence from bottom to top of said first array, the second scrolling sequence indicative to an observer viewing said second array of the display a direction of onward traffic flow toward said display.

15. A method according to claim 14, further comprising the steps of: illuminating a second array of lights in a second scrolling sequence in conjunction with said first array of lights when said first array is illuminating lights according to said first scrolling sequence, wherein said second array scrolling sequence comprises illuminating lights of said second array in sequence from bottom to top of said second array, the second array scrolling sequence indicative to an observer viewing said second array of the display a direction of onward traffic flow toward said display.

16. A method according to claim 14 comprising, in a first array comprising five lights, illuminating said five lights in said first scrolling sequence which comprises the steps of:

(i) illuminating first, second and fifth lights of said first array;

(ii) illuminating second and third lights of said first array;

(iii) illuminating third and fourth lights of said first array;

(iv) illuminating first, fourth and fifth lights of said first array; and (v) repeating steps (i) to (iv).

17. A computer program product comprising machine or computer-readable program elements for configuring a data processing apparatus or computer to implement the method of any of claim 14.

18. A computer carrier medium carrying a computer program product according to claim 17.

19. A traffic junction comprising at least one display according to claim 1.

20. A display according to claim 1, wherein said first array comprises five lights and said second scrolling sequence comprises illumination of said five lights in the following sequence:

(i) fifth light illuminated;

(ii) fourth and fifth lights illuminated;

(iii) third and fourth lights illuminated;

(iv) second and third lights illuminated;

(v) first and second lights illuminated;

(vi) first light illuminated; and (vii) repeat steps (i) to (vi).

21. A method according to claim 15 comprising, in a second array comprising five lights, illuminating said five lights in said second array scrolling sequence which comprises the steps of:

(i) illuminating first, fourth and fifth lights of said second array;

(ii) illuminating third and fourth lights of said second array;

(iii) illuminating second and third lights of said second array;

(iv) illuminating first, second and fifth lights of said second array; and (v) repeating steps (i) to (iv).

22. A method according to claim 14 comprising, in a first array comprising five lights, illuminating said five lights in said first scrolling sequence which comprises the steps of:

(i) illuminating first light of said first array;

(ii) illuminating first and second lights of said first array;

(iii) illuminating second and third lights of said first array;

(iv) illuminating third and fourth lights of said first array;

(v) illuminating fourth and fifth lights of said first array;

(vi) illuminating fifth light of said first array; and (vii) repeating steps (i) to (vi).

23. A method according to claim 14, comprising, in a first array comprising five lights, illuminating said five lights in said second scrolling sequence which comprises the steps of:

(i) illuminating fifth light of said first array;

(ii) illuminating fourth and fifth lights of said first array;

(iii) illuminating third and fourth lights of said first array;

(iv) illuminating second and third lights of said first array;

(v) illuminating first and second lights of said first array;

(vi) illuminating first light of said first array; and (vii) repeating steps (i) to (vi).

* * * * *